US012029366B2

(12) United States Patent
Curcio

(10) Patent No.: US 12,029,366 B2
(45) Date of Patent: Jul. 9, 2024

(54) FLEXIBLE MEANS FOR SECURING A CLEANING DEVICE TO FOOTWEAR

(71) Applicant: Matthew Curcio, Irvine, CA (US)

(72) Inventor: Matthew Curcio, Irvine, CA (US)

( * ) Notice: Subject to any disclaimer, the term of this patent is extended or adjusted under 35 U.S.C. 154(b) by 117 days.

(21) Appl. No.: 17/684,026

(22) Filed: Mar. 1, 2022

(65) Prior Publication Data

US 2022/0273155 A1 Sep. 1, 2022

Related U.S. Application Data

(60) Provisional application No. 63/154,951, filed on Mar. 1, 2021.

(51) Int. Cl.

| | |
|---|---|
| ***A47L 13/42*** | (2006.01) |
| ***A43C 19/00*** | (2006.01) |
| ***A46B 5/00*** | (2006.01) |
| ***A46B 5/04*** | (2006.01) |
| ***A47L 13/12*** | (2006.01) |
| ***A47L 13/16*** | (2006.01) |
| ***A47L 13/282*** | (2006.01) |

(52) U.S. Cl.

CPC ..... *A47L 13/42* (2013.01); *A43C 19/00* (2013.01); *A46B 5/0095* (2013.01); *A46B 5/04* (2013.01); *A47L 13/12* (2013.01); *A47L 13/16* (2013.01); *A47L 13/282* (2013.01); *A46B 2200/3033* (2013.01)

(58) Field of Classification Search

CPC ..... A47L 13/12; A47L 13/16; A47L 13/42; A47L 13/282; A43C 19/00

See application file for complete search history.

(56) References Cited

U.S. PATENT DOCUMENTS

| | | | |
|---|---|---|---|
| 3,526,917 | A | 9/1970 | Haywood |
| 3,680,170 | A | 8/1972 | Sims |
| 3,699,672 | A | 10/1972 | Sims |
| 6,038,726 | A | 3/2000 | Kelly et al. |
| 6,052,856 | A | 4/2000 | DeMoya et al. |
| 8,060,974 | B2 | 11/2011 | McLogan |
| 2004/0040110 | A1 | 3/2004 | Fletcher et al. |
| 2006/0101667 | A1 | 5/2006 | Kane |
| 2006/0265828 | A1 | 11/2006 | Mallatt et al. |

(Continued)

FOREIGN PATENT DOCUMENTS

| | | | | |
|---|---|---|---|---|
| FR | 2867357 A1 | 9/2005 | | |
| GB | 298879 A | * 10/1928 | ..... | A47L 13/02 |

(Continued)

OTHER PUBLICATIONS

Machine translation: WO2011034278; Kim, Y. (Year: 2011).*

*Primary Examiner* — Natasha N Campbell

(74) *Attorney, Agent, or Firm* — Jacob M. Ward; Ward Law Office LLC

(57) ABSTRACT

A cleaning device to be worn on footwear of a user includes a shoe attachment means configured to removably connect to the user's footwear, a cleaning element configured to removably connect to the shoe attachment means, and a coupling interface including a first connecting means positioned on the shoe attachment means and a second connecting means positioned on the cleaning element. The first connecting means and the second connecting means are configured to removably connect the shoe attachment means to the cleaning element.

18 Claims, 10 Drawing Sheets

(56) References Cited

U.S. PATENT DOCUMENTS

| | | | | |
|---|---|---|---|---|
| 2008/0060110 | A1* | 3/2008 | Schmelzer | A44B 1/32<br>2/69 |
| 2008/0216271 | A1 | 9/2008 | Marler | |
| 2018/0070715 | A1* | 3/2018 | Peterson | A46B 5/04 |
| 2020/0154971 | A1* | 5/2020 | Peters, Jr. | A43B 13/36 |

FOREIGN PATENT DOCUMENTS

| | | | | |
|---|---|---|---|---|
| GB | 2446462 | A | 8/2008 | |
| JP | 2004081789 | A | 3/2004 | |
| WO | WO-2011034278 | A2 * | 3/2011 | A43B 13/36 |

* cited by examiner

FLEXIBLE MEANS FOR SECURING A CLEANING DEVICE TO FOOTWEAR

CROSS-REFERENCE TO RELATED APPLICATIONS

This application claims the benefit of U.S. Provisional Application Ser. No. 63/154,951, filed on Mar. 1, 2021. The entire disclosure of the above application is incorporated herein by reference.

FIELD

The present invention relates generally to a cleaning device and, more particularly, to a cleaning device attached to footwear.

INTRODUCTION

This section provides background information related to the present disclosure which is not necessarily prior art Effective cleaning requires the right equipment and a lot of energy. Most often, people use their hands and upper body for tasks such as mopping, wiping, scrubbing, absorbing, and drying, as examples. This can be extremely uncomfortable in low, hard to reach places. Additionally, typical cleaning practices can be exhausting for muscle systems in the hands, arms, and upper body, and also very difficult on the back. Difficult stains and spills that require a lot of forceful, repetitive movements can easily lead to overall fatigue and suboptimal results when relying solely on upper body strength.

For most people, the lower body, including the legs and feet, generates significantly more power and force and has a much greater endurance than the upper body. In fact, it is known that legs provide up to four times more force than arms. Accordingly, various known cleaning devices have been adapted to connect to a user's foot or footwear. For example, as shown in U.S. Pat. No. 6,038,726, it is known to wear a sock or slipper that also functions as a cleaning device. Similarly, U.S. Pat. No. 6,052,856 describes a mopping device that may be attached to a user's footwear.

However, these known cleaning devices often do not provide a secure attachment means that facilitates effective cleaning and optimum power and force transfer from the user's footwear directly to the cleaning element of the cleaning device. These known cleaning devices are also cumbersome to use and are not practical for allowing a user to move freely from one area to another without removing the entire cleaning device from the user's footwear. Finally, known cleaning devices do not allow for interchangeable cleaning elements that allow the cleaning device to be used in a variety of settings and in response to different types of spill, stains, and other messes that require different cleaning techniques.

Accordingly, there is a continuing need for a cleaning device adapted to be connected to footwear that provides a secure attachment means capable of facilitating effective cleaning and optimum power and force transfer from a user's footwear directly to the cleaning element of the cleaning device. Desirably, the cleaning device would be adaptable in a variety of settings, would not be cumbersome to use, and would allow a user to move freely from one area to another without removing the cleaning device from the user's footwear.

SUMMARY

In concordance with the instant disclosure, a cleaning device adapted to be connected to footwear that provides a secure attachment means and optimum power and force, is adaptable in a variety of settings, and allows a user to move freely from one area to another without removing the cleaning device from the user's footwear, has surprisingly been discovered.

In certain embodiments, a cleaning device to be worn on footwear of a user includes a shoe attachment means configured to removably connect to the user's footwear, a cleaning element configured to removably connect to the shoe attachment means, and a coupling interface including a first connecting means positioned on the shoe attachment means and a second connecting means positioned on the cleaning element. The first connecting means and the second connecting means are configured to removably connect the shoe attachment means to the cleaning element.

In certain embodiments, a cleaning device to be worn on footwear of a user includes a shoe attachment means configured to removably connect to the user's footwear, a cleaning element configured to removably connect to the shoe attachment means, and a coupling interface including at least one opening positioned on the shoe attachment means and at least one corresponding fastener positioned on the cleaning element. Each opening is configured to receive a disc portion of each corresponding fastener. The disc portion of each fastener is positioned adjacent a top rim of each opening when the cleaning element is connected to the shoe attachment means.

In certain embodiments, a method of cleaning comprises the steps of providing a cleaning device configured to removably connect to a user's footwear, the cleaning device including a shoe attachment means, a cleaning element removably connected to the shoe attachment means, and a coupling interface including a first connecting means positioned on the shoe attachment means and a second connecting means positioned on the cleaning element. The first connecting means and the second connecting means are configured to removably connect the shoe attachment means to the cleaning element. The method of cleaning further comprises the steps of selecting the cleaning element, connecting the cleaning element to the shoe attachment means, applying the shoe attachment means to the footwear, and performing a cleaning task.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
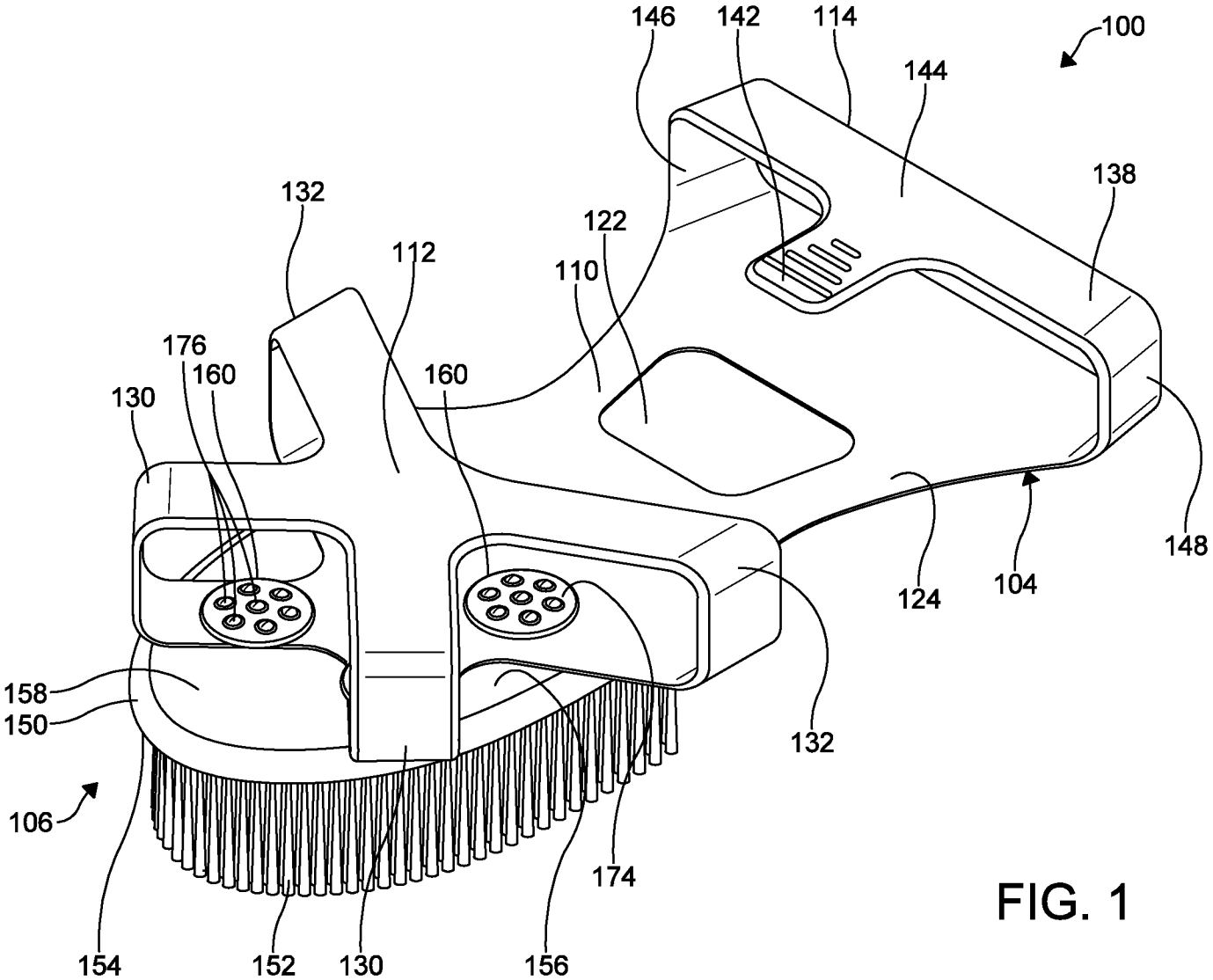
FIG. 1 is a top perspective view of a cleaning device according to one embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-13, a cleaning device 100 for removably attaching to a user's footwear 102 is shown. The cleaning device 100 may include a shoe attachment means 104, a cleaning element 106, and a coupling interface 108 that connects the shoe attachment means 104 to the cleaning element 106.

The shoe attachment means 104 may include a base portion 110, a front portion 112, and a rear portion 114. During use, the base portion 110 of the shoe attachment means 104 may be positioned adjacent a bottom surface 116 of the user's footwear 102. The front portion 112 and the rear portion 114 of the shoe attachment means 104 may be configured to connect to, or be disposed around, a toe section 118 of the user's footwear 102 and a heel section 120 of the user's footwear 102, respectively.

Figure 2:
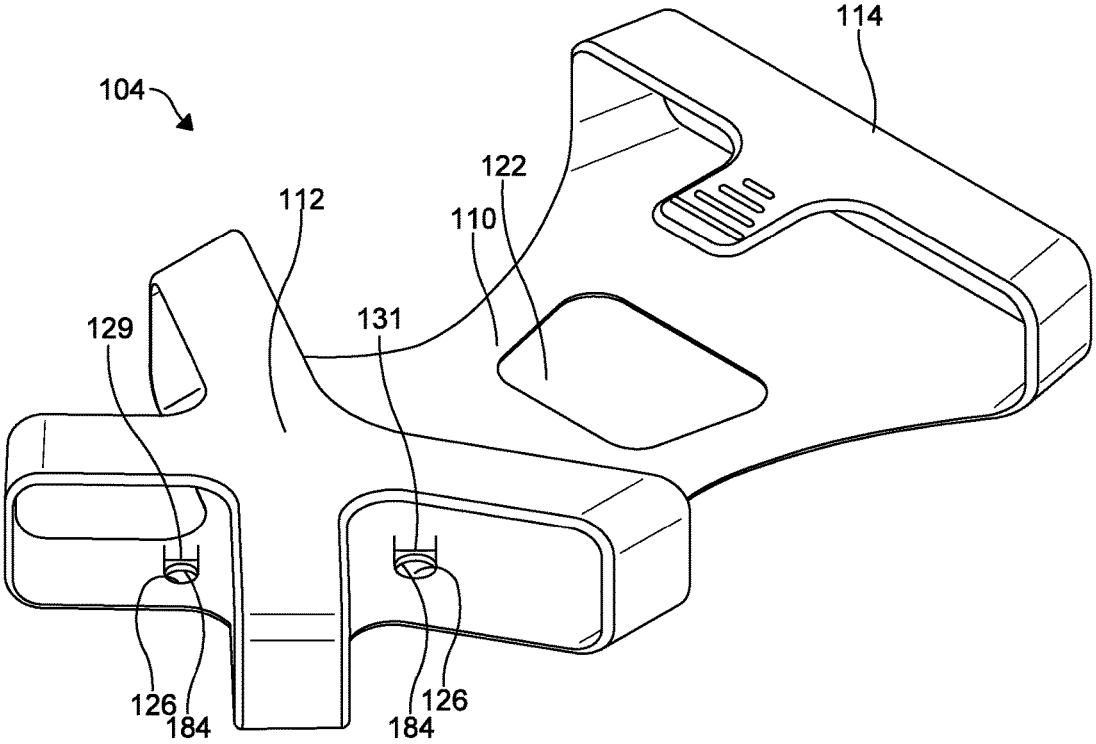
FIG. 2 is a top perspective view of the cleaning device of FIG. 1, a cleaning element of the cleaning device removed from a shoe attachment means of the cleaning device.
Figure 2:
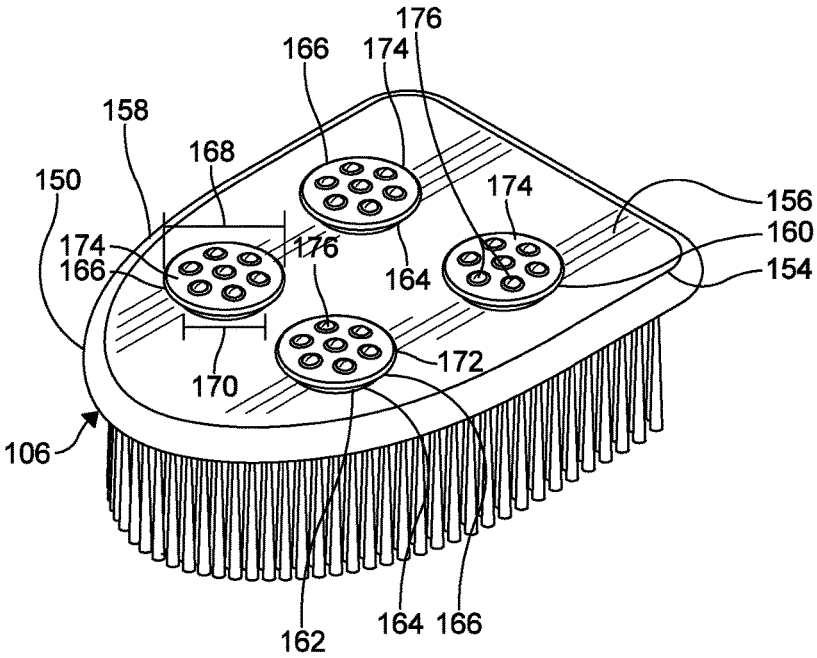
Figure 3:
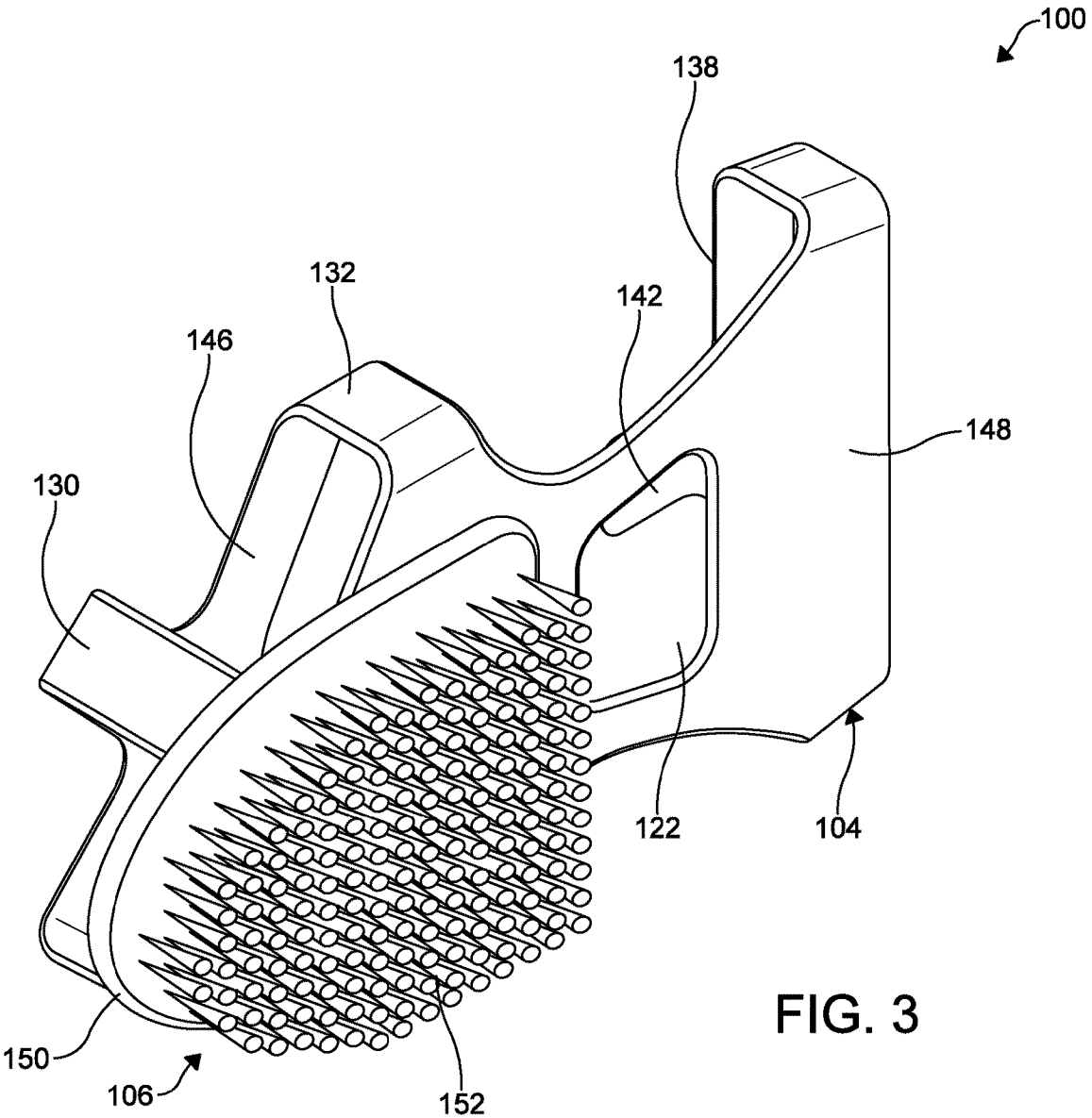
FIG. 3 is a bottom perspective view of the cleaning device of FIG. 1.
Figure 4:
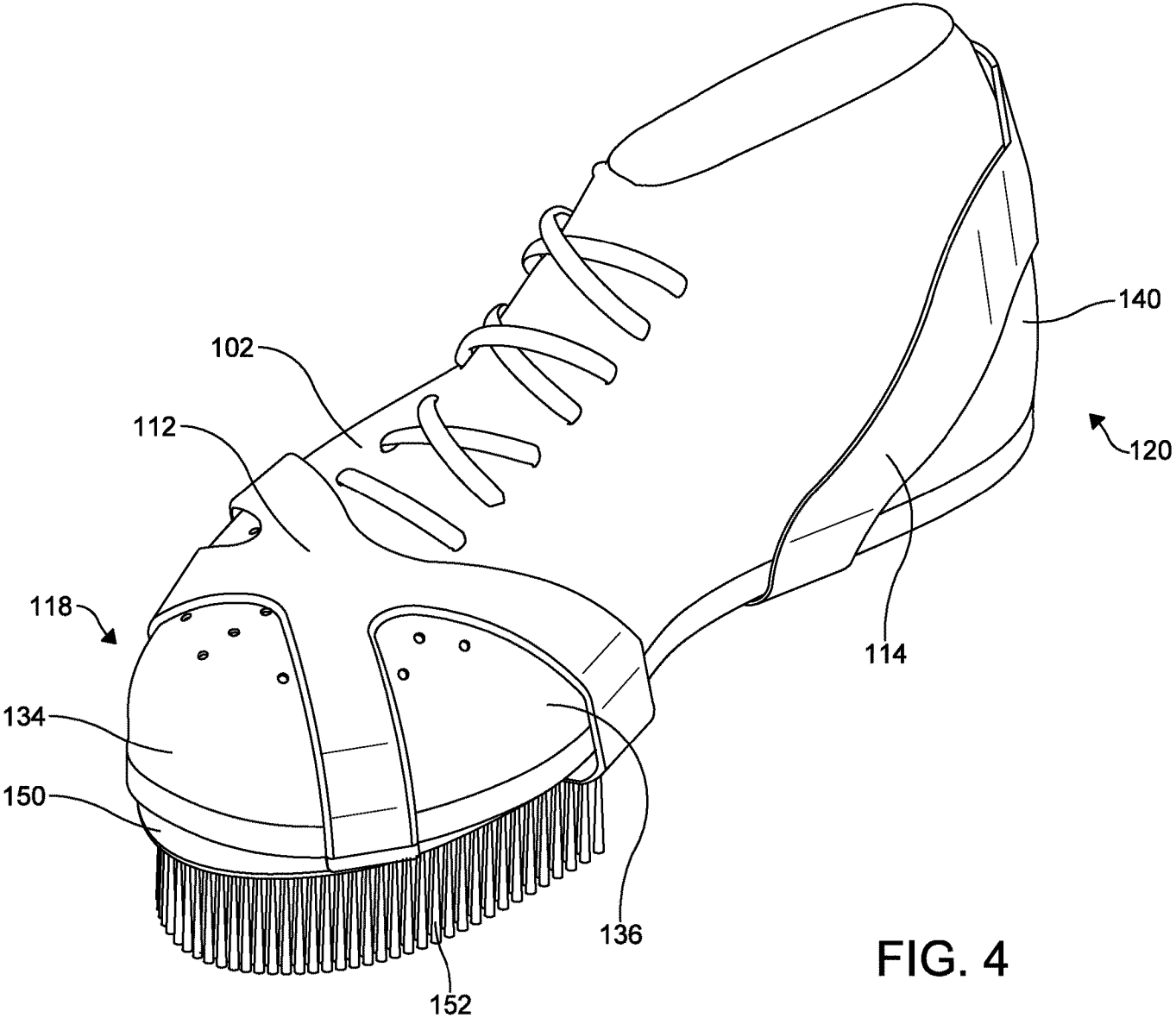
FIG. 4 is a top perspective view of the cleaning device of FIG. 1 disposed on a user's footwear.

As shown in FIGS. 1-3, one or more of the base portion 110, the front portion 112, and the rear portion 114 may be a solid material or may have one or more apertures 122 disposed therein. In certain embodiments, the apertures 122 may allow for increased flexibility of the shoe attachment means 104 during application to, and removal from, the user's footwear 102. In one particular embodiment, an aperture 122 may be disposed in a middle section 124 of the base portion 110 of the shoe attachment means 104.

One or more openings 126, as shown in FIG. 2, may be disposed in the base portion 110 of the shoe attachment means 104, according to certain embodiments. The openings 126 may be configured to removably connect to the cleaning element 106, thereby allowing the user to connect the cleaning element 106 to the shoe attachment means 104 and disconnect the cleaning element 106 from the shoe attachment means 104. In certain more particular embodiments, the openings 126 may be positioned in the base portion 110 of the shoe attachment means 104 such that the openings 126 are adjacent a ball section 128 of the user's footwear 102 when the shoe attachment means 104 is applied to the user's footwear 102. The openings 126 may be uniform in size, according to certain embodiments, or may vary in size, according to certain other embodiments. As one non-limiting example, in a more particular embodiment shown in FIG. 2, the shoe attachment means may include openings 126 having a first diameter 129 and openings having a second diameter 131 that is greater than then first diameter 129.

In a more particular embodiment, the front portion 112 of the shoe attachment means 104 may include at least one toe strap 130 and at least one side strap 132, as shown in FIG. 1. The toe strap 130 may extend around a front section 134 of the user's footwear 102 and the side strap 132 may extend around side section 136 of the user's footwear 102. In certain more particular embodiments, the rear portion 114 of the shoe attachment means 104 may include a heel strap 138 configured to extend around a rear section 140 of the user's footwear 102.

Figure 5:
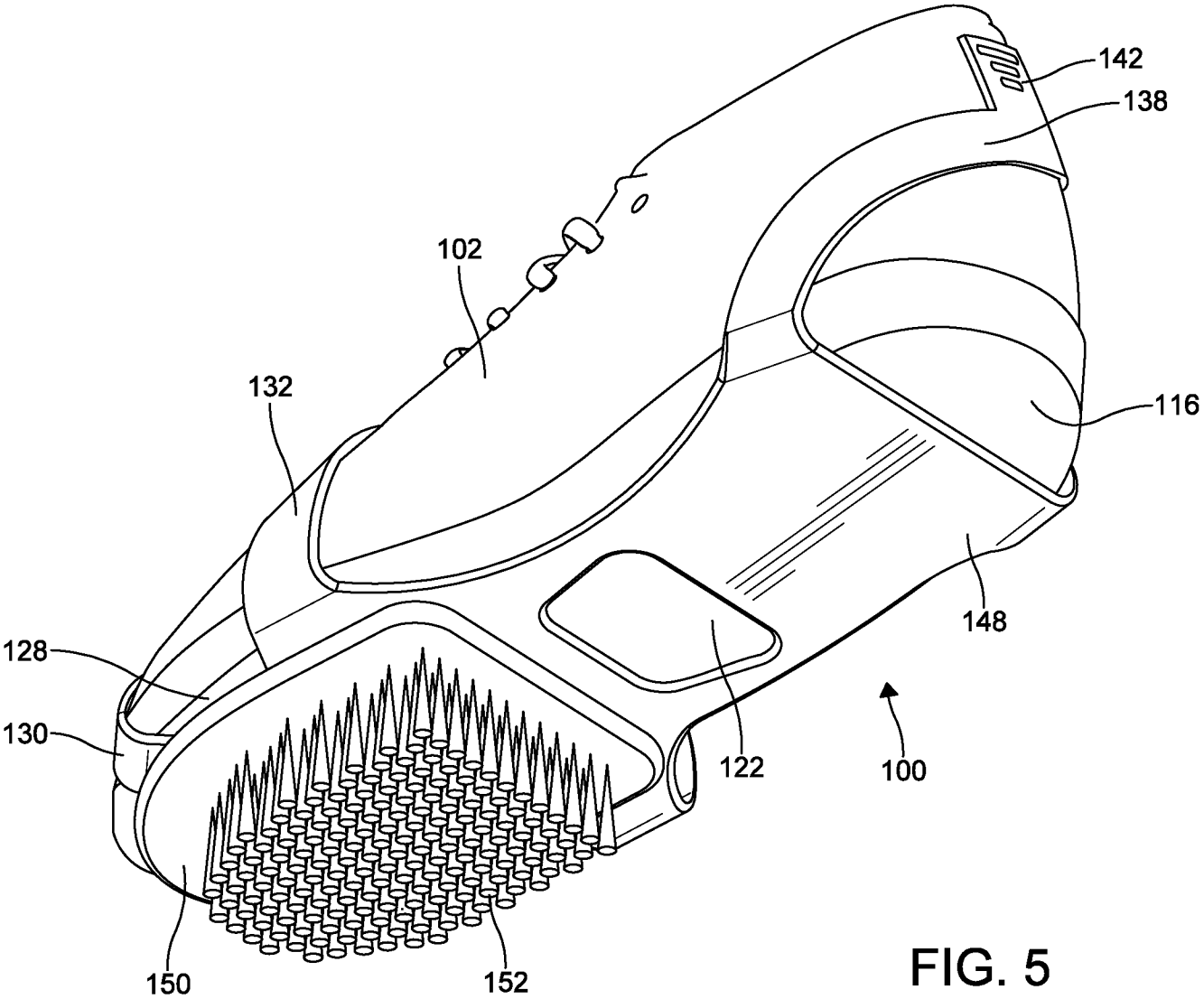
FIG. 5 is a bottom perspective view of the cleaning device of FIG. 4.
Figure 7:
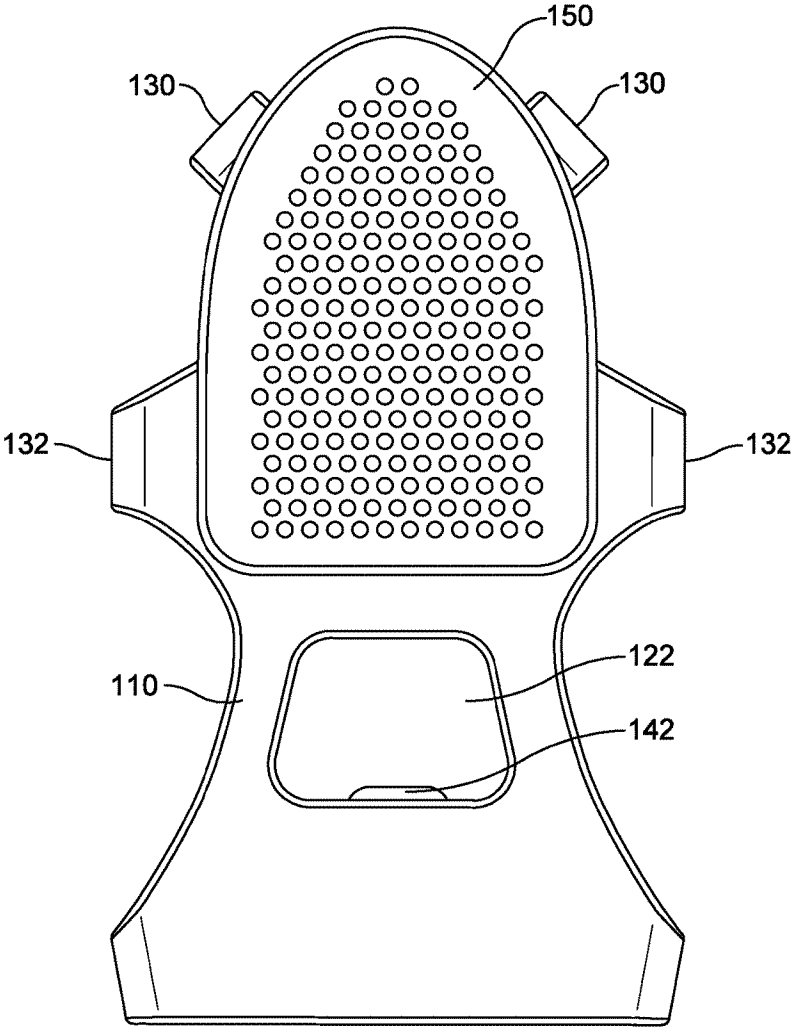
FIG. 7 is a bottom plan view of the cleaning device of FIG. 1.
Figure 6:
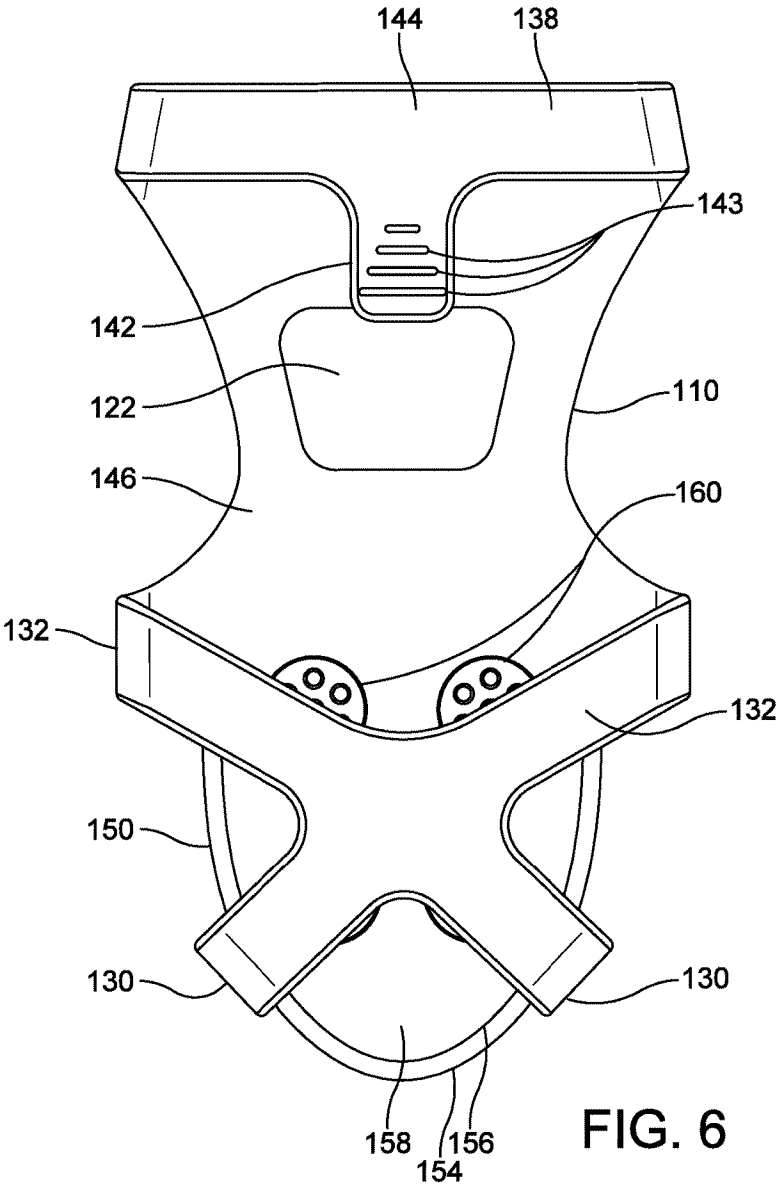
FIG. 6 is a top plan view of the cleaning device of FIG. 1.
Figure 10:
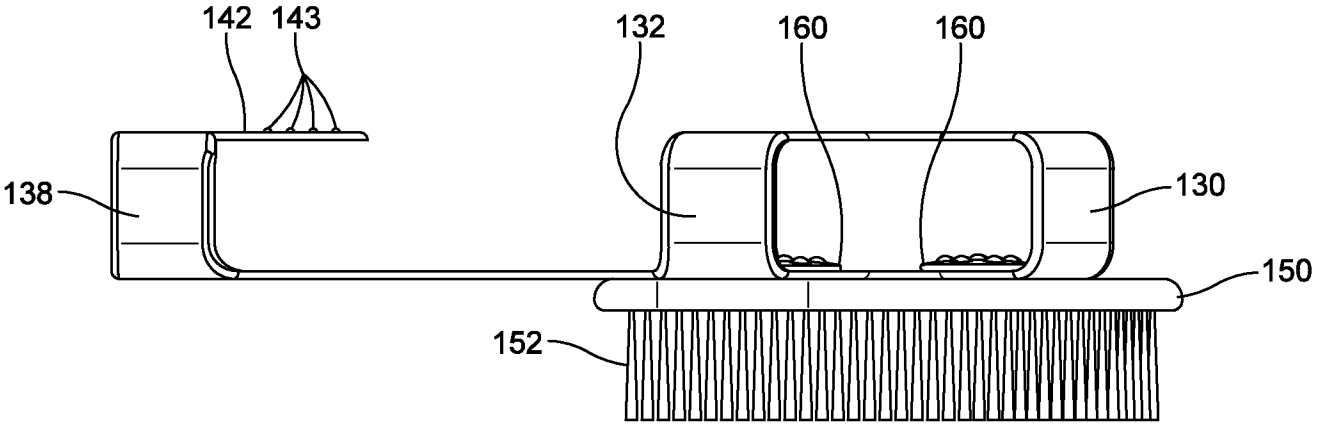
FIG. 10 is a side elevational view of the cleaning device of FIG. 1.

With reference to FIGS. 1, 5, and 6, the rear portion 114 of the shoe attachment means 104 may include a tab 142 that extends out from the shoe attachment means 104. The tab 142 may be disposed on a midsection 144 of the heel strap 138, according to certain more particular embodiments. The tab 142 may be integral with the shoe attachment means 104, or may be a separate component that is permanently, semi-permanently, or removably attached to the shoe attachment means 104. In certain embodiments, as shown in FIGS. 6 and 10, a tab grip 143 may be disposed on the tab 142. Additional tabs 142 may be disposed on the shoe attachment means 104 in any desired locations, as determined by one of skill in the art.

The shoe attachment means 104 may be made using any flexible, durable, lightweight material. In a preferred embodiment, the shoe attachment means 104 may be fabricated from an environmentally resistant, highly elastic polymer capable of withstanding wear and tear from excessive use and repeated application to and removal from the user's footwear 102. According to certain embodiments, the flexible, durable material may allow the user to easily stretch the shoe attachment means 104 during application to fit snuggly around the user's footwear 102 by forming a tight friction fit on the user's footwear 102 once applied.

According to certain embodiments, an inner surface 146 of the shoe attachment means 104 may be smooth so as not to cause harm to the user's footwear 102 during use. In certain other embodiments, the inner surface 146 may be rough or textured in order to militate against movement of the shoe attachment means 104 relative to the user's footwear 102 during use. A textured surface may also be included on an outer surface 148 of the shoe attachment means 104, according to certain embodiments, to prevent the user from slipping and falling during use.

In certain embodiments, the shoe attachment means 104, including the base portion 110, the front portion 112, and the rear portion 114, may be fabricated by forming a single component that is molded from one piece of continuous material rather than a plurality of different components connected to one another. In certain embodiments, a combination of materials may be used to form the shoe attachment means 104.

In yet another embodiment, the base portion 110, the front portion 112, and the rear portion 114 may be separate components that are permanently, semi-permanently, or removably connected to one another using any suitable connecting means. The positions of the base portion 110, the front portion 112, and the rear portion 114, relative to one another, may be adjustable, according to certain embodiments.

The shoe attachment means 104 may be manufactured having various lengths and widths to fit a range of different footwear 102 forms and sizes. In certain embodiments, the shoe attachment means 104 may have a generally oval-like or rectangular shape, and in certain other embodiments, the shoe attachment means 104 may have a shape that more closely resembles the shape of the user's footwear 102, as shown in FIG. 5. It should be appreciated that one skilled in the art may fabricate the shoe attachment means 104 using any suitable materials. Likewise, the shoe attachment means 104 may be any desirable shape, size, and configuration, as determined by one of skill in the art. It should be appreciated that a skilled artisan may employ different formations and arrangements for the shoe attachment means 104, within the scope of this disclosure.

With renewed reference to FIGS. 1 and 2, the cleaning element 106 of the cleaning device 100 may include an attachment portion 150 configured to connect to the shoe attachment means 104 and a cleaning portion 152 that is integral with, or permanently, semi-permanently, or removably connected to, a bottom end 154 of the attachment portion 150. It should be appreciated that one of skill in the art may employ any suitable means for permanently or removably connecting the cleaning portion 152 to the attachment portion 150 to form the cleaning element 106.

The attachment portion 150 of the cleaning element 106, according to certain embodiments, may be fabricated using a rigid, semi-rigid, or flexible material, or a combination of materials. The bottom end 154 of the attachment portion 150 may be connected to the cleaning portion 152, and a top end 156 may be positioned adjacent the ball section 128 of the user's footwear 102. The attachment portion 150 may be configured to receive pressure or force from the ball section 128 of the user's footwear 102, thereby allowing the user to exert force down onto the cleaning element 106. In certain more particular embodiments, a rigid, hard material such as plastic, as one-nonlimiting example, may be used to fabricate the attachment portion 150 of the cleaning element 106. A top surface 158 of the top end 156 of the attachment portion 150 may be rough or textured (not shown) in order to increase traction between the user's footwear 102 and the top surface 158 of the top end 156 of the attachment portion 150 during use.

One or more fasteners 160 may be used to couple the shoe attachment means 104 and the cleaning element 106. When coupled, each fastener 160 may extend upwardly away from the top end 156 of the attachment portion 150, according to certain embodiments. At a first end 162 of each fastener 160, a protrusion 164 may be integral with, or permanently, semi-permanently, or removably connected to, the top end 156 of the attachment portion 150. A disc portion 166 having a width 168 that is greater than a width 170 of the protrusion 164 may be positioned at a second end 172 of the fastener 160. An upper surface 174 of the fastener 160 may be rough or textured in order to increase traction between the user's footwear 102 and the cleaning element 106.

In certain more particular embodiments, a gripping pattern 176 may be included on the upper surface 174 of the fastener 160 to further increase traction and grip between the user's footwear 102 and cleaning element 106. It should be understood that one of skill in the art may select any suitable material, shape, size, and configuration for the attachment portion 150, including the fasteners 160, as desired.

Figure 11:
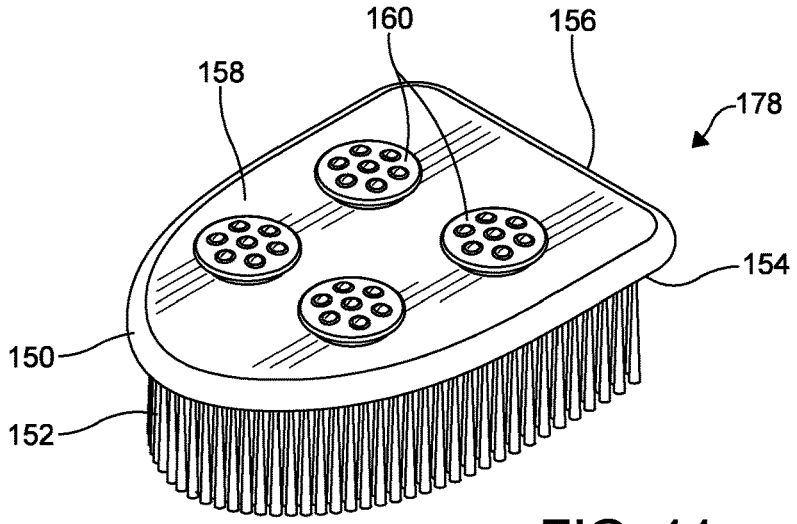
FIG. 11 is a top perspective view of a cleaning element according to one embodiment of the present disclosure.
Figure 12:
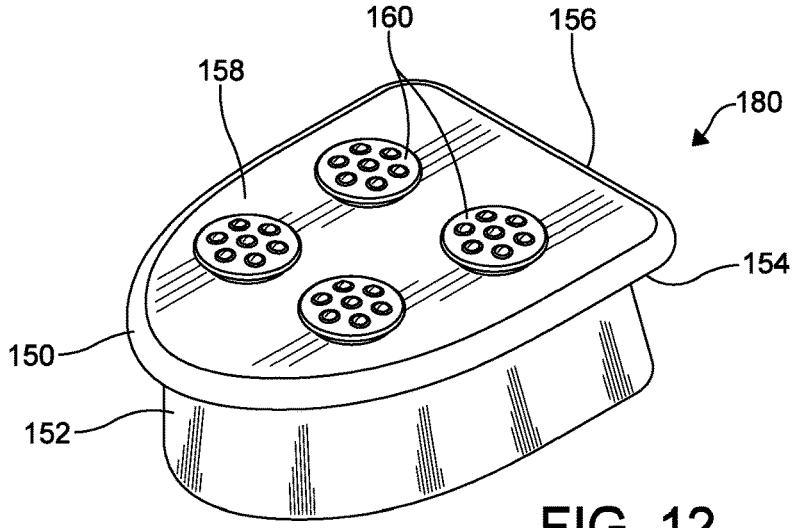
FIG. 12 is a top perspective view of a cleaning element according to another embodiment of the present disclosure.
Figure 13:
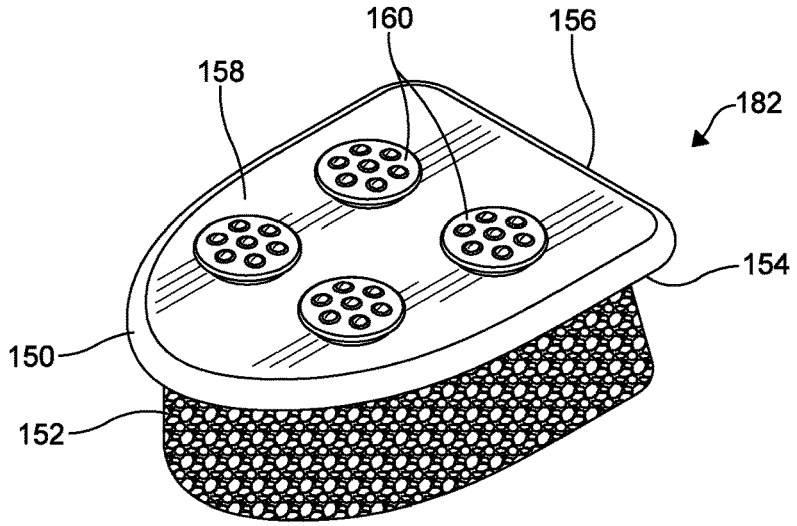
FIG. 13 is a top perspective view of a cleaning element according to yet another embodiment of the present disclosure.

The cleaning portion 152 of the cleaning element 106 may be adapted to clean a variety of surfaces using various cleaning techniques such as scrubbing, brushing, rubbing, scraping, washing, wiping, mopping, absorbing, removing, and drying, as non-limiting examples. As shown in FIGS. 11-13, a variety of different cleaning elements 106 may be used in combination with the shoe attachment means 104 such as a brush cleaning element 178, a sponge cleaning element 180, and a microfiber towel cleaning element 182, as non-limiting examples. In certain embodiments, the cleaning portion 152 may be adapted to perform more than one cleaning technique (not shown). As one non-limiting example, a section of the cleaning portion 152 may be adapted to scrape, and another section of the cleaning portion 152 may be adapted to mop or absorb.

In certain embodiments, the cleaning portion 152 may be permanently connected to or integral with the attachment portion 150 of the cleaning element 106 such that the cleaning element 106 in its entirety is interchangeable with respect to the shoe attachment means 104. As a non-limiting example, the user may start with the sponge cleaning element 180 attached to the shoe attachment means 104 and then remove the sponge cleaning element 180 and replace it with the brush cleaning element 178. A skilled artisan may use any suitable means for permanently connecting the cleaning portion 152 to the attachment portion 150, such as glue or adhesive, as non-limiting examples.

In certain other embodiments, the cleaning portion 152 may be interchangeable with respect to the attachment portion 150 of the cleaning element 106 (not shown). As a non-limiting example, the user may start with a cleaning portion 152 configured to scrap or brush that is attached to the attachment portion 150 of the cleaning element 106, remove the cleaning portion 152 configured to scrap or brush from the attachment portion 150, and then replace it with a cleaning portion 152 including a microfiber towel. A skilled artisan may select any suitable means, such as hook and loop, snaps, and friction fit, as a non-limiting examples, for removably connecting the cleaning portion 152 to the attachment portion 150. In certain embodiments, a section of the cleaning portion 152 may be removable with respect to the entire cleaning portion 152 (not shown). As one non-limiting example, a microfiber towel cover (not shown) may be removable with respect to the cleaning portion 152, allowing the user to wash, dry, or replace the microfiber towel cover, as needed, without replacing the entire cleaning portion 152.

The cleaning element 106, including each of the cleaning portion 152 and the attachment portion 150, may be any shape, size, and configuration suitable for connecting to the shoe attachment means 104. The cleaning element 106 may be larger than, smaller than, or the same length and width as the shoe attachment means 104, a portion of the shoe attachment means 104, or the user's footwear 102, as desired. The attachment portion 150 and the cleaning portion 152 may be integral with one another or separate components.

The cleaning portion 152 and the attachment portion 150 may be made from flexible material, rigid material, or a combination of materials. In certain embodiments, more than one material may be used to form one or both of the cleaning portion 152 and the attachment portion 150. In certain preferred embodiments, a durable, reusable, washable material is used to form some or all of the cleaning portion 152 and the attachment portion 150. In certain embodiments, a portion or all of the cleaning element 106 may be fabricated from a single-use material. It should be appreciated that one skilled in the art may use any material, combination of materials, shapes, sizes, and configurations for the cleaning element 106, as desired.

Figure 8:
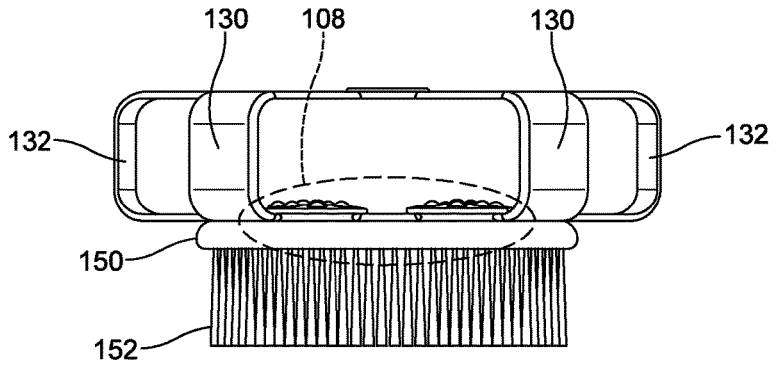
FIG. 8 is a front elevational view of the cleaning device of FIG. 1, including a coupling interface call out by a circle formed in dotted lines.
Figure 9:
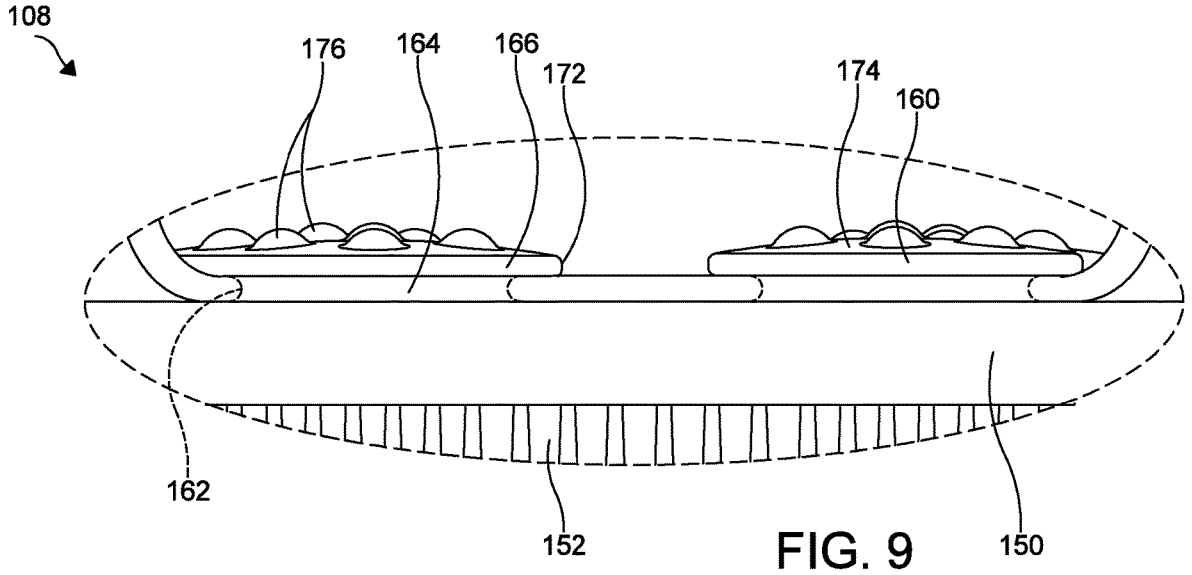
FIG. 9 is an enlarged front elevational view of the coupling interface call out of FIG. 8.

The coupling interface 108, as shown in FIGS. 8 and 9, may be used to permanently, semi-permanently, or removably connect the cleaning element 106 to the shoe attachment means 104, according to various embodiments. The coupling interface 108 may be formed by connecting any number of fasteners 160 with any number of corresponding openings 126 configured to receive the fasteners 160. According to certain embodiments, each disc portion 166 of the fasteners 160, when received by the corresponding opening 126, extends upwardly through the opening 126 and beyond a top rim 184 of each opening 126.

According to a more particular embodiment, the coupling interface 108 is formed when each of four openings 126 disposed in the shoe attachment means 104 is disposed around the protrusion 164 of a corresponding fastener 160, such that the disc portion 166 of each fastener 160 is positioned beyond the top rim 184 of each opening 126 and adjacent the inner surface 146 of the base portion 110 of the shoe attachment means 104. The top end 156 of the attachment portion 150 is disposed adjacent the outer surface 148 of the base portion 110 of the shoe attachment means 104, and each opening 126 is disposed adjacent the protrusion 164 of each corresponding fastener 160.

Each disc portion 166 of the fasteners 160, having the width 168 that is greater than the width 170 of each protrusion 164, militates against the openings 126 becoming disengaged with or disconnected from the fastener 160 during use. Advantageously, in certain embodiments, the coupling interface 108 is configured to allow a portion of the cleaning element 106 to directly contact the user's footwear 102 allowing for optimal force and power transfer from the user's footwear 102 to the cleaning element 106. In certain more preferred embodiments, the upper surface 174 of the fasteners 160 directly contacts the user's footwear 102 allowing for optimal force and power transfer from the user's footwear 102 to the cleaning element 106.

It should be appreciated that one of skill in the art may select any suitable number of fasteners 160 and corresponding openings 126, as desired. Likewise, the coupling interface 108 may be fabricated using any suitable material or materials, may be formed using any desirable shapes, sizes, and configurations, and may include any suitable permanent, semi-permanent, or removable connecting means, as desired. It should be further appreciated that one of skill in the art may select any coupling interface 108 having any suitable components adapted to connect the cleaning element 106 to the attachment means 104 and, in certain embodiments, adapted to allow a portion of the cleaning element 106 to directly contact the user's footwear 102.

In operation, according to certain embodiments of the present disclosure, the user may select the desired cleaning element 106, as well as the appropriate shoe attachment means 104, and connect the two using the coupling interface 108. Once the user has secured the cleaning element 106 to the shoe attachment means 104, the cleaning device 100 may be applied to the user's footwear. Advantageously, the flexible, elastic material of the shoe attachment means 104 may be easily applied and securely fastened to a variety of footwear 102. The user may apply the cleaning device 100 to the footwear 102 by first disposing the toe straps 130 and the side straps 132 around the front section 134 and the side section 136 of the footwear 102, and then by using the tab 142 to pull the heel strap 138 around the rear section 140 of the footwear 102. The user may then perform the desired cleaning operation. It should be appreciated that the cleaning element 106 may be connected and disconnected from the shoe attachment means 104 before and after the shoe attachment means 104 has been applied to the user's footwear 102, as desired.

Advantageously, the cleaning device 100, according to various embodiments, is versatile with respect to securely fitting onto footwear 102 of various shapes and sizes. The coupling interface 108 allows for a selection of universal cleaning elements 106, such as those shown in FIGS. 11-13, to form a secure fit with the shoe attachment means 104, even if the shoe attachment means 104 are manufactured in varying sizes as well. Likewise, various cleaning elements 106 having various shapes and sizes that are designed to perform different functions related to cleaning may be easily interchanged, replaced, cleaned, and removed for ease of motion, as needed. As non-limiting examples, soft brushes, scrub brushes, absorbent pads, and sanding materials may be incorporated into the selection of cleaning elements 106 suitable for use with the shoe attachment means 104.

The coupling interface 108 also makes it easy for the user to quickly remove the cleaning element 106 when moving from one area to another without have to remove the shoe attachment means 104. Additionally, the coupling interface 108, and, more specifically, the plurality of fasteners 160 in direct contact with the bottom surface 116 of the user's footwear 102 allows the user to more effectively clean due to the optimum force and endurance being transferred from the user's footwear 102 directly to the cleaning element 106.

Figure 14:
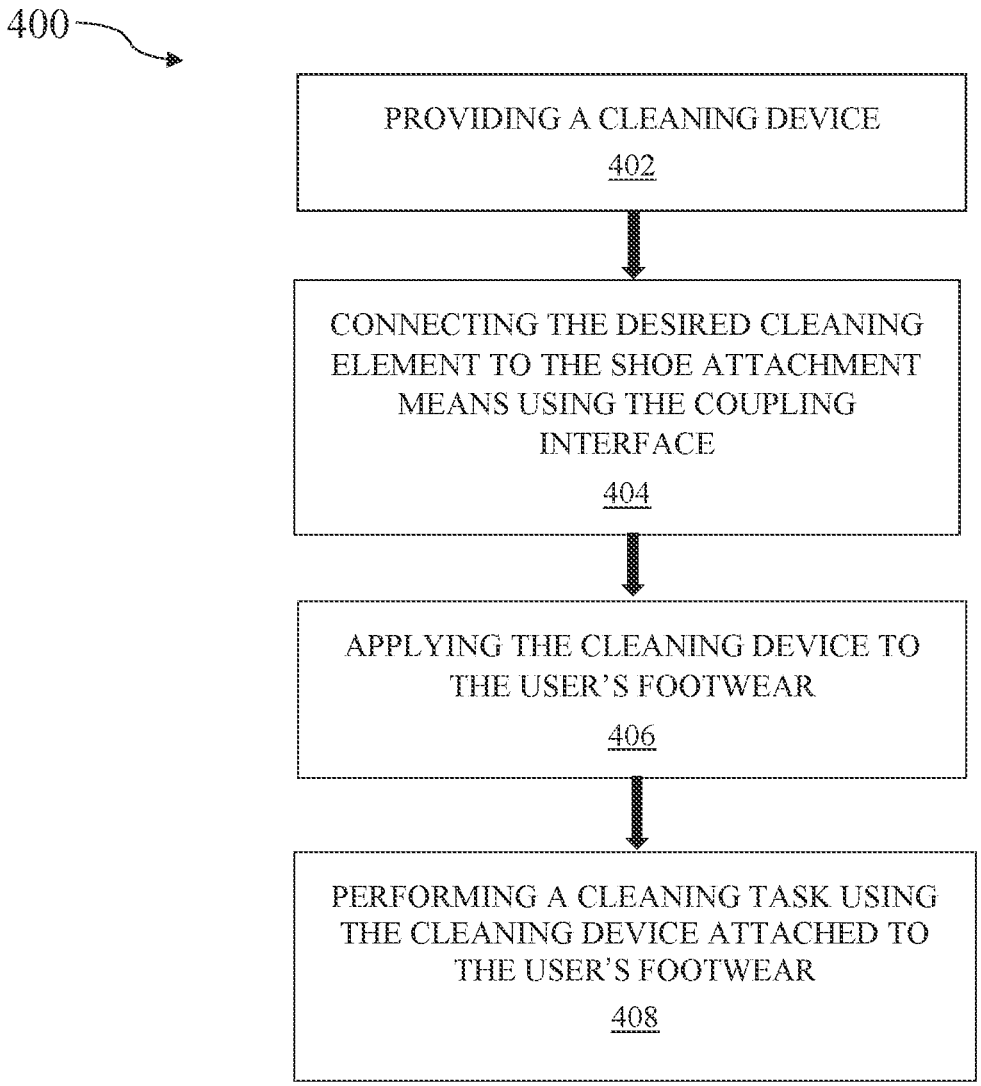
FIG. 14 is a method of cleaning according to one embodiment of the present disclosure.

In yet another embodiment of the present disclosure, with reference to FIG. 14, a method 400 of cleaning, according to various embodiments, is shown. The method 400 of cleaning may include a first step 402 of providing the cleaning device 100 including the shoe attachment means 104 and the desired cleaning element 106. The method 400 may further include a second step 404 of connecting the desired cleaning element 106 to the shoe attachment means 104 using the coupling interface 108. A third step 406 may include applying the cleaning device 100 to the user's footwear 102. In a next step 408, the user may perform a cleaning task using the cleaning device 100 attached to the user's footwear 102.

It should be appreciated that the user may need to perform additional steps, according to various embodiments of the present disclosure. As one non-limiting example, an additional step may include removing the cleaning device 100 from the user's footwear 102 in order to disconnect the cleaning element 106 from the shoe attachment means 104 and replace the cleaning element 106, as needed. As another non-limiting example, an additional step may include removing the cleaning element 106 from the shoe attachment means 104 in order to move to another location efficiently and safely without needing to remove the entire cleaning device 100. It should be further appreciated that the user may need to perform the steps in a different order. As one non-limiting example, the user may apply the shoe attachment means 104 to the user's footwear before connecting the cleaning element 106 using the coupling interface 108.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, components and methods can be made within the scope of the present technology, with substantially similar results.

What is claimed is:

1. A cleaning device to be worn on footwear of a user, comprising:

a shoe attachment means configured to removably connect to the user's footwear, the shoe attachment means including a base portion that is positioned adjacent the user's footwear, the base portion including a first connecting means, the first connecting means including an opening, and the base portion including an aperture disposed in a midsection of the base portion of the shoe attachment means;

a cleaning element configured to removably connect to the shoe attachment means; and a coupling interface including the first connecting means positioned on the shoe attachment means and a second connecting means positioned on the cleaning element, wherein the first connecting means and the second connecting means are configured to removably connect the shoe attachment means to the cleaning element.

2. The cleaning device of claim 1, wherein the shoe attachment means is fabricated from an environmentally resistant, highly elastic polymer.

3. The cleaning device of claim 1, wherein the shoe attachment means is fabricated as a single component that is formed from one piece of continuous material.

4. The cleaning device of claim 1, wherein the shoe attachment means includes a toe strap, a side strap, and a heel strap.

5. The cleaning device of claim 4, wherein the heel strap includes a tab.

6. The cleaning device of claim 1, wherein the second connecting means includes a fastener that is configured to be received by the opening.

7. The cleaning device of claim 6, wherein the fastener includes a protrusion at a first end of the fastener that is adjacent the cleaning element and a disc portion at a second end of the fastener that is spaced apart from the cleaning element.

8. The cleaning device of claim 7, wherein a first width of the protrusion is smaller than a second width of the disc portion.

9. The cleaning device of claim 8, wherein the disc portion of the fastener is positioned adjacent a top rim of the opening.

10. The cleaning device of claim 6, wherein an upper surface of the fastener is configured to be in direct contact with the user's footwear.

11. The cleaning device of claim 10, wherein the upper surface of the fastener includes a gripping pattern.

12. The cleaning device of claim 1, wherein a portion of the cleaning element is in direct contact with the user's footwear.

13. The cleaning device of claim 1, wherein the cleaning element includes a cleaning portion at a first end of the cleaning element and an attachment portion at a second end of the cleaning element adjacent the shoe attachment means.

14. The cleaning device of claim 1, wherein the cleaning element is interchangeable with respect to the shoe attachment means.

15. A cleaning device to be worn on footwear of a user, comprising:

a shoe attachment means configured to removably connect to the user's footwear, the shoe attachment means including a base portion that is positioned adjacent the user's footwear, the base portion including a first connecting means, the first connecting means including an opening, and the base portion including an aperture disposed in a midsection of the base portion of the shoe attachment means;

a cleaning element configured to removably connect to the shoe attachment means; and a coupling interface including the first connecting means, the first connecting means including the opening positioned on the shoe attachment means and a fastener positioned on the cleaning element, wherein the opening is configured to receive a disc portion of the fastener, and wherein the disc portion of the fastener is positioned adjacent a top rim of the opening when the cleaning element is connected to the shoe attachment means.

16. The cleaning device of claim 15, wherein the fastener includes a protrusion at a first end of the fastener that is adjacent the cleaning element, the disc portion is positioned at a second end of the fastener, the second end being spaced apart from the cleaning element, and a first width of the protrusion is smaller than a second width of the disc portion.

17. The cleaning device of claim 16, wherein the upper surface of the fastener is in direct contact with the user's footwear.

18. A method of cleaning, comprising:

providing a cleaning device configured to removably connect to a user's footwear, the cleaning device including a shoe attachment means, the shoe attachment means including a base portion that is positioned adjacent the user's footwear, the base portion including a first connecting means, the first connecting means including an opening, and the base portion including an aperture disposed in a midsection of the base portion of the shoe attachment means, a cleaning element removably connected to the shoe attachment means, and a coupling interface including the first connecting means positioned on the shoe attachment means and a second connecting means positioned on the cleaning element, wherein the first connecting means and the second connecting means are configured to removably connect the shoe attachment means to the cleaning element;

selecting the cleaning element;

connecting the cleaning element to the shoe attachment means;

applying the shoe attachment means to the footwear; and performing a cleaning task.

* * * * *